US012403990B2

(12) United States Patent
Westrick et al.

(10) Patent No.: US 12,403,990 B2
(45) Date of Patent: Sep. 2, 2025

(54) PONTOON/TRITOON WATERCRAFT WITH COMPOSITE CHASSIS

(71) Applicant: Hyper Electric Marine Inc., Huntertown, IN (US)

(72) Inventors: Michael D. Westrick, Huntertown, IN (US); Griff Suelzer, Coldwater, MI (US); Steven V. Werling, Hudson, IN (US); Kaleb J. Reinhart, Huntertown, IN (US); Matthew R. Williams, Fort Wayne, IN (US)

(73) Assignee: Hyper Electric Marine Inc., Huntertown, IN (US)

( * ) Notice: Subject to any disclaimer, the term of this patent is extended or adjusted under 35 U.S.C. 154(b) by 639 days.

(21) Appl. No.: 17/737,496

(22) Filed: May 5, 2022

(65) Prior Publication Data

US 2023/0356812 A1 Nov. 9, 2023

(51) Int. Cl.

| | |
|---|---|
| ***B63B 35/38*** | (2006.01) |
| ***B63B 1/12*** | (2006.01) |
| ***B63B 5/24*** | (2006.01) |

(52) U.S. Cl.

CPC ..... *B63B 35/38* (2013.01); *B63B 1/121* (2013.01); *B63B 5/24* (2013.01); *B63B 2001/123* (2013.01); *B63B 1/125* (2013.01); *B63B 2005/242* (2013.01)

(58) Field of Classification Search

CPC ..... B63B 35/38; B63B 1/121; B63B 1/125; B63B 5/24; B63B 2001/123; B63B 2005/242

See application file for complete search history.

(56) References Cited

U.S. PATENT DOCUMENTS

| | | | | |
|---|---|---|---|---|
| 3,614,937 | A * | 10/1971 | Schulman | B63B 1/121 114/283 |
| 5,325,623 | A | 7/1994 | Sakuraoka et al. | |
| 7,004,092 | B2 | 2/2006 | Yetter et al. | |
| 7,263,940 | B2 | 9/2007 | Yetter et al. | |
| 8,714,099 | B1 | 5/2014 | Manderfeld | |
| 8,955,452 | B1 | 2/2015 | Wilson | |
| 9,073,605 | B2 | 7/2015 | Hall | |
| 9,862,468 | B2 | 1/2018 | O'Sullivan et al. | |
| 10,427,769 | B1 | 10/2019 | Garrett | |
| 11,091,234 | B1 | 8/2021 | Rose et al. | |
| 2005/0098077 | A1* | 5/2005 | Blaisdell | B63B 3/48 114/61.22 |

* cited by examiner

*Primary Examiner* — Stephen P Avila
(74) *Attorney, Agent, or Firm* — TAYLOR & EDELSTEIN, PC

(57) ABSTRACT

A watercraft includes: a watercraft body; and a pontoon frame system coupled with the watercraft body, the pontoon frame system including: a plurality of pontoons spaced apart from one another and including a forward end, a rearward end, a first outboard pontoon, and a second outboard pontoon; and a chassis coupled with and at least partially supporting the watercraft body, the chassis supported by and coupling together the plurality of pontoons, the chassis including a composite body coupled with the first outboard pontoon and the second outboard pontoon at the forward end and the rearward end.

15 Claims, 4 Drawing Sheets

PONTOON/TRITOON WATERCRAFT WITH COMPOSITE CHASSIS

BACKGROUND OF THE INVENTION

1. Field of the Invention

The present invention relates to boats using two or more pontoons, and, more particularly, to the chassis of such boats.

2. Description of the Related Art

Certain boats (which can be referred to herein as watercraft) may include two or more pontoons as floatation devices. Boats that use two pontoons are herein referred to as pontoon boats, and boats that use three pontoons are herein referred to as tritoon boats. Pontoons are tubes (which can be referred to as floatation tubes) or hulls that are airtight and hollow so that they are able to float, and they are made of known materials.

Existing pontoon/tritoon watercraft experience problems with their chassis design. More specifically, existing pontoon/tritoon watercraft chassis designs require at least 100 man-hours to construct, suffer from poor tolerances in the construction, and experience excessive twisting of the pontoon frame system under high speed and/or rough water conditions. Such twisting results in weakening of the connective fasteners attached to the flotation tubes and the chassis, as well as of the connections between the chassis, the flooring, the furniture, the helm, the railings, the trim, the motor mounts, and other structures mounted above the chassis. Additionally, such twisting creates an unpleasant ride for the passengers, thus diminishing the ride experience.

Such chassis designs have a plurality of transverse beams coupled with each of the pontoons. Each beam extends transversely across, and thus perpendicular to, the pontoons. The pontoons extend longitudinally running fore to aft. Further, a forward-most transverse beam is attached to the forward end of the pontoons, a rearward-most transverse beam is attached to the rearward end of the pontoons, and a plurality of transverse beams are spaced apart between these forward-most and rearward-most transverse beams.

What is needed in the art is an improved, cost-effective way to mitigate the aforementioned problems associated with pontoon/tritoon watercraft.

SUMMARY OF THE INVENTION

The present invention provides a pontoon/tritoon chassis including a composite structure with various attachment features.

The invention in one form is directed to a pontoon frame system of a watercraft including a watercraft body, the pontoon frame system being coupled with the watercraft body, the pontoon frame system including: a plurality of pontoons spaced apart from one another and including a forward end, a rearward end, a first outboard pontoon, and a second outboard pontoon; and a chassis configured for being coupled with and for at least partially supporting the watercraft body, the chassis supported by and coupling together the plurality of pontoons, the chassis including a composite body coupled with the first outboard pontoon and the second outboard pontoon at the forward end and the rearward end.

The invention in another form is directed to a watercraft including: a watercraft body; and a pontoon frame system coupled with the watercraft body, the pontoon frame system including: a plurality of pontoons spaced apart from one another and including a forward end, a rearward end, a first outboard pontoon, and a second outboard pontoon; and a chassis coupled with and at least partially supporting the watercraft body, the chassis supported by and coupling together the plurality of pontoons, the chassis including a composite body coupled with the first outboard pontoon and the second outboard pontoon at the forward end and the rearward end.

The invention in yet another form is directed to a method of using a watercraft, the method including the steps of: providing that the watercraft includes: a watercraft body; and a pontoon frame system coupled with the watercraft body, the pontoon frame system including: a plurality of pontoons spaced apart from one another and including a forward end, a rearward end, a first outboard pontoon, and a second outboard pontoon; and a chassis coupled with and at least partially supporting the watercraft body, the chassis supported by and coupling together the plurality of pontoons, the chassis including a composite body coupled with the first outboard pontoon and the second outboard pontoon at the forward end and the rearward end; and floating the watercraft.

An advantage of the present invention is that it provides for making a pontoon/tritoon watercraft chassis with considerably lower cost and ease of build.

An advantage of the present invention is that it provides a pontoon/tritoon watercraft chassis that is easier to maintain.

Yet another advantage of the present invention is that it provides a pontoon/tritoon watercraft chassis that is more rigid and stable under rough water and/or high-speed operation. The chassis provides stability to an entire platform, eliminating twisting and flexing associated with known pontoon/tritoon watercraft.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

The terms "forward", "rearward", "left" and "right", when used herein in connection with the watercraft and/or components thereof, are usually determined with reference to the direction of forward operative travel of the watercraft, but they should not be construed as limiting. The terms "longitudinal" and "transverse" are determined with reference to the fore-and-aft direction of the watercraft and are equally not to be construed as limiting. The terms "downstream" and "upstream" are analogous to "rearward" and "forward," respectively.

Figure 1:
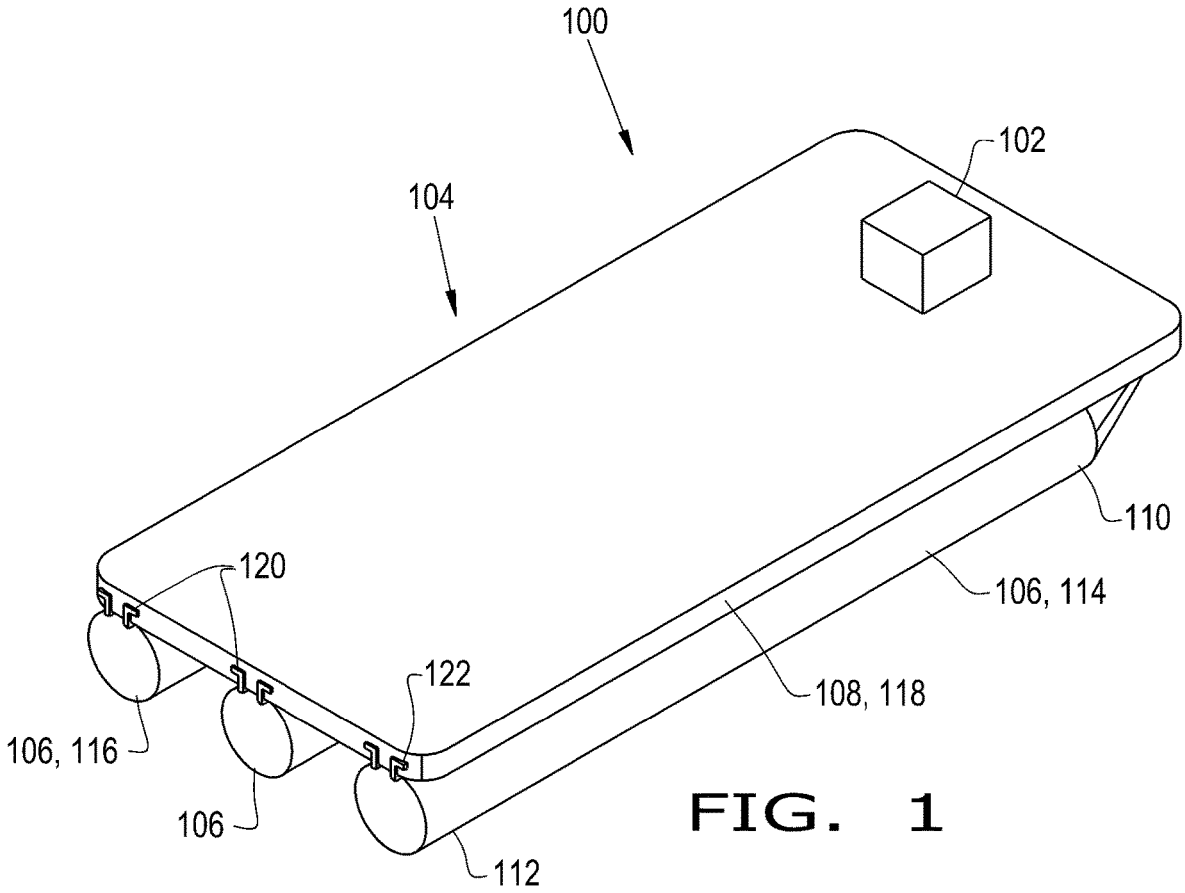
FIG. 1 is a top, perspective view of an exemplary embodiment of a watercraft, the watercraft including a pontoon frame system including pontoons and a chassis with a composite body, in accordance with an exemplary embodiment of the present invention.

Referring now to the drawings, and more particularly to FIG. 1, there is shown a watercraft 100 (which can be referred to herein as a boat 100) which generally includes a watercraft body 102 and a pontoon frame system 104 coupled with the watercraft body 102 (such as by way of fasteners 324, discussed below). The watercraft body 102 is shown schematically and can include the parts of the watercraft mounted primarily atop the pontoon frame system 304; these parts can include, by way of example and not limitation, a floor, decking, a platform, railings, furniture, a helm, and any other structures that are mounted on top of the floor. Though shown relatively small in FIG. 1, watercraft body 102 can span at least the entire longitudinal and transverse extent of chassis 108.

Pontoon frame system 104 incudes a plurality of pontoons 106 and a chassis 108. Pontoons 106 are spaced apart from one another in a transverse direction and extend in a longitudinal direction of watercraft 100. As is known, watercraft 100 with pontoons 106 typically includes two pontoons 106 (a pontoon boat) or three pontoons 106 (a tritoon boat). Though the figures show watercraft 100 of the present invention formed as a tritoon boat, it can be readily appreciated that the watercraft of the present invention can be formed as a pontoon boat in the figures by removing the middle pontoon (as well as features of watercraft 100 associated with the middle pontoon 106). Pontoons 106 include a forward end 110, a rearward end 112, a first outboard pontoon 114, and a second outboard pontoon 116. Regarding a tritoon boat (as shown), the outboard pontoons 114, 116 are the transverse side pontoons 106. It can be appreciated that if the watercraft has only two pontoons 106 (a pontoon boat), then the two pontoons 106 can still be deemed to be first and second outboard pontoons, respectively. Pontoons 106 include risers 120 attached thereto.

Chassis 108 of pontoon frame system 104 is coupled with and at least partially supports watercraft body 102. Chassis 108 can be coupled with watercraft body 102 in any suitable manner, though one way is shown and discussed below with respect to fasteners 324 in conjunction with FIGS. 3-6. Further, chassis 108 is supported by and couples together pontoons 106. Chassis 108 includes a composite body 118 (which can include a matrix material (such as a resin) with fibrous material embedded therein and can be referred to as a unibody) coupled with each pontoon 106 at forward end 110 and rearward end 112 of pontoons 106. Composite body 118 can have any suitable shape, such as a slab (shown) or the like. Composite body 118 can be made of any suitable material and in any suitable way. Such materials include, but are not limited to, fiberglass, carbon fiber, polymers, plastics, other composites, castable metals, and/or the like. By way of example and not limitation, one option for the material is a carbon fiber-based product, made by Vectorply of Phenix City, Alabama, the product being marketed as a VECTORULTRA™ with a product code of C-QX 2300. Composite body can be molded, formed, and/or cast, for example.

To couple together composite body 118 with pontoons 106, a plurality of risers 120 attached to pontoons 106 can be slidably received in corresponding slots 122 formed in composite body 118. Risers 120 can be made of any suitable material, such as a metal (such as aluminum, or steel), a polymer, carbon fiber, and/or fiberglass, and can be made in any suitable manner. Risers 120 are coupled with pontoons 106 in any suitable manner, such as by way of brackets, fasteners, and/or welding, and any devices making these connections can be made of any suitable material, such as aluminum, steel, carbon fiber, fiberglass, and/or the like. A single riser 120 can be attached to a respective platoon 106 and run substantially the length of the respective pontoon 106 from forward end 110 to rearward end 112 of the pontoon 106. Alternatively, rather than a single, long riser 120, a plurality of risers 120—shorter in their longitudinal extent—can be attached to and spaced longitudinally apart from one another along the length of the respective pontoon 106 from forward end 110 to rearward end 112 of the pontoon 106. Each riser 120 can be formed with a right-angle and thus have substantially an L-shape. Further, composite body 118 can include slots 122 which matingly receive respective risers 120. Slots 122, as shown, can thus have a right-angle and thus have substantially an L-shape. These slots 122 can be formed in composite body 118 when composite body 118 is, for example, molded, or can be cut or machined into composite body 118 subsequent to molding of composite body 118. During assembly of pontoon frame system 104, risers 120 can be slidably received by slots 122, either before or after risers 120 are attached to pontoons 106.

Figure 2:
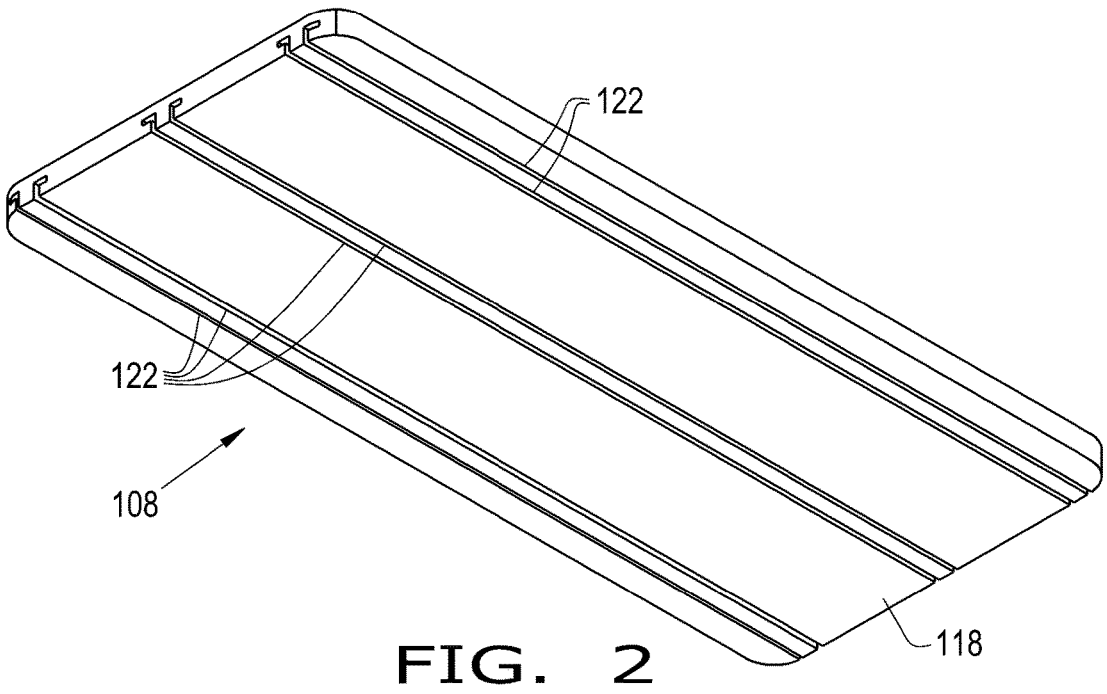
FIG. 2 is a bottom, perspective view of the chassis with the composite body of FIG. 1, in accordance with an exemplary embodiment of the present invention.

Referring now to FIG. 2, there is shown a bottom, perspective view of chassis 108 of watercraft 100, with portions broken away. Chassis 108 is thus shown by itself, without risers 120 connected thereto. Chassis 108 is shown to include composite body 118 with three slots 122 corresponding to three pontoons 106. Each slot 122, as shown, can extend the longitudinal extent of composite body 118. Each slot 122, with its right-angle formation, is configured to matingly receive risers 120. During assembly, risers 120 can be inserted into a respective slot 122 at either end of composite body 118. Securing risers 120 within slots 122 can occur in any suitable manner, such as by way of a press fit, an interference fit, using an adhesive, or the like.

Figure 3:
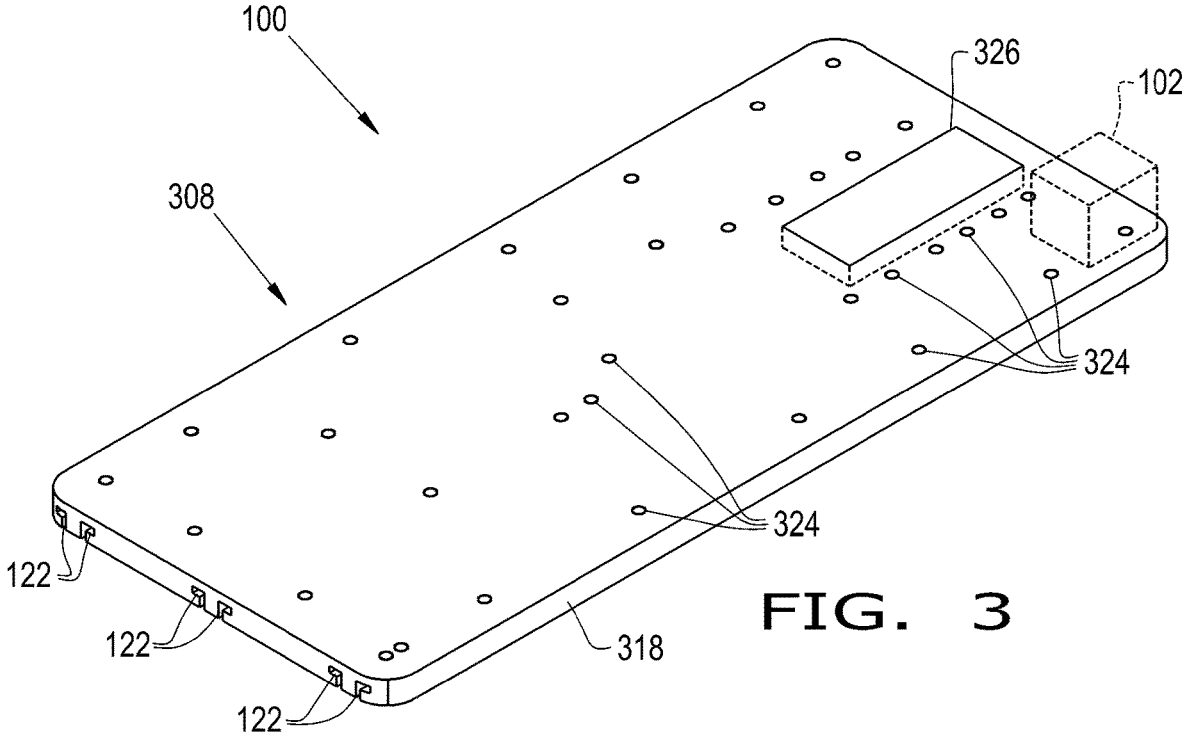
FIG. 3 is a top, perspective view of another exemplary embodiment of the chassis of the watercraft, in accordance with an exemplary embodiment of the present invention.

Referring now to FIG. 3, there is shown a top, perspective view of another embodiment of the chassis of watercraft 100, according to the present invention. Certain prior reference numbers with respect to the chassis are increased by a multiple of 100 and are substantially similar to the structures and function of the embodiments shown in FIGS. 1-2, unless otherwise shown and/or described. Thus, the chassis and composite body are now labeled 308 and 318, respectively, in FIG. 2. One substantial difference between chassis 108 and chassis 308 is that composite body 318 includes a plurality of fasteners 324 attached thereto, which can be made of any suitable material, such as aluminum, steel, carbon fiber, fiberglass, and/or the like. More specifically fasteners 324 are embedded in the composite material of composite body 318; such fasteners 324 can be referred to as captivated machine screw nuts 324, and in FIG. 3 fasteners 324 are embedded in a top portion of composite body 318. Alternatively, rather than being screw nuts, fasteners 324 can be screws, bolts, or the like. Fasteners 324 serve to mount all or portions of watercraft body 102. Thus, by way of example, fasteners 324 can serve to mount the floor, helm, railings, furniture, and/or any other structures that are required to be mounted on top of the floor.

Another substantial difference is that composite body 318 includes a high-voltage battery pack 326 embedded therein. Pack 326 is thus captured within composite body 318, which is thick enough to embed such a pack 326. In this way, pack 326, being under the floor (part of watercraft body 102), is isolated from passengers above the floor. Access can be had to pack 326 in any suitable manner. Further, though pack 326 is shown in FIG. 3 relatively small and placed between fasteners 324, this is done only for illustrative purposes; it can be appreciated that pack 326 can be larger than what is shown in FIG. 3 (as large as needed) and can be positioned under and/or above fasteners 324. Pack 326 can be formed of any suitable material, and may include a substantially rigid shell or enclosure. Pack 326 can be used, for example, as part of an all-electric boat design (a boat powered by electricity). Pack 326 can include therein one or more batteries as is suitable for the intended use. Further, any or all high voltage and high current cables can be at least partially contained or encapsulated within pack 326 and/or routed underneath the flooring of watercraft body 102 as well, eliminating the risk of accidental electrocution. Any such cables may route to an inverter and/or an outboard motor. Further, any such cables, if not in pack 326, can be routed in composite body 318 and/or within recesses 528 (below). It can be appreciated that pack 326 can be included in any of the embodiments of the present invention shown herein.

Figure 4:
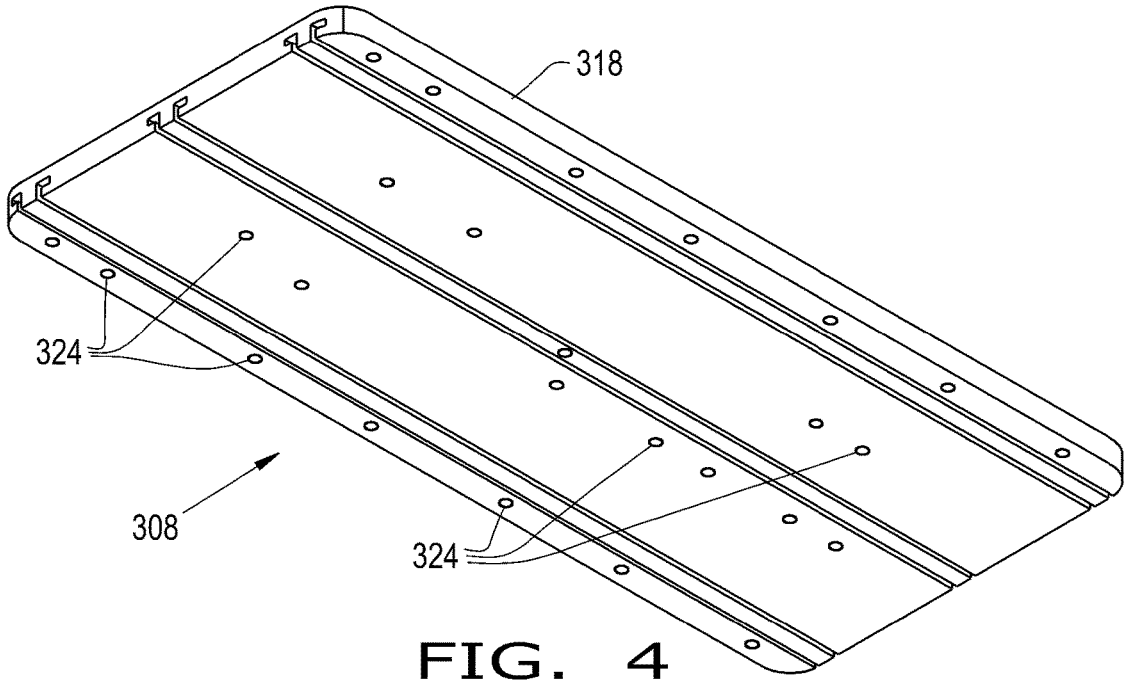
FIG. 4 is a bottom, perspective view of the chassis of FIG. 3.

Referring now to FIG. 4, there is shown a bottom, perspective view of chassis 308 of FIG. 3. Chassis 308 is shown to include composite body 318 with three slots 122 corresponding to three pontoons 106. Each slot 122, as shown, can extend the longitudinal extent of composite body 318. Further, additional fasteners 324 are embedded on a bottom portion of composite body 318, similar to how fasteners 324 are embedded on the top portion of composite body 318, though the positions of the fasteners 324 on the bottom portion of composite body 318 can be in locations which do not correspond to the positions of the fasteners 324 on the top portion, as shown when comparing FIGS. 3 and 4. These fasteners 324 on the bottom portion are configured to mount various structures, for example, trim pieces, motor supports, and any other suspended structures that require attachment to the bottom of composite body 318.

Figure 5:
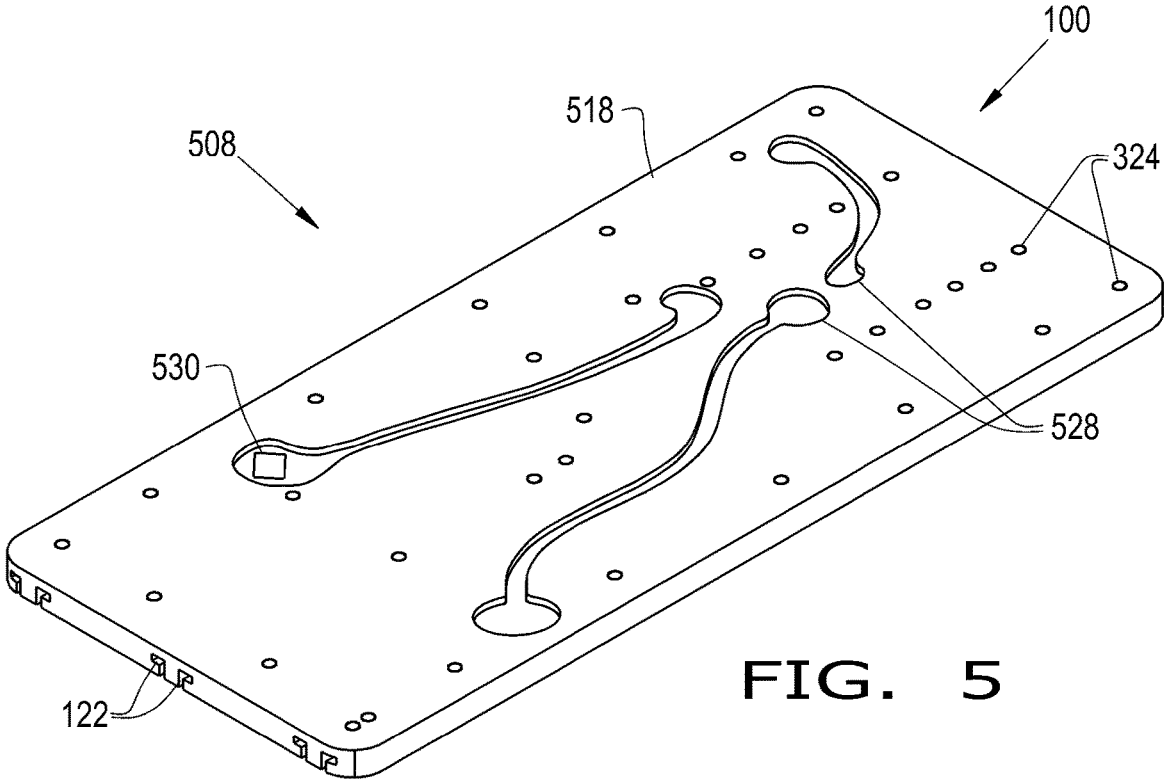
FIG. 5 is a top, perspective view of yet another exemplary embodiment of the chassis of the watercraft, in accordance with an exemplary embodiment of the present invention.

Referring now to FIG. 5, there is shown a top, perspective view of another embodiment of the chassis of watercraft 100, according to the present invention. Certain prior reference numbers with respect to the chassis are increased by a multiple of 100 and are substantially similar to the structures and function of the embodiments shown in FIGS. 1-4, unless otherwise shown and/or described. Thus, the chassis and composite body are now labeled 508 and 518, respectively, in FIG. 5. Composite body 518 includes slots 122 and fasteners 324 embedded therein. One substantial difference between chassis 308 and chassis 508 is that composite body 518 includes at least one recess 528 configured for receiving and, as is necessary, routing a device 530 therein (device 530 is shown schematically). FIG. 5 shows three such recesses formed in the top portion of composite body 518. Device 530 can be any suitable device, including, but not limited to cooling lines, electrical conduits, lighting cables or tubing, stereo cables or tubing, and/or any other cabling or tubing that requires routing. Recesses 528 are thus configured for receiving and routing therein any such device 530.

Figure 6:
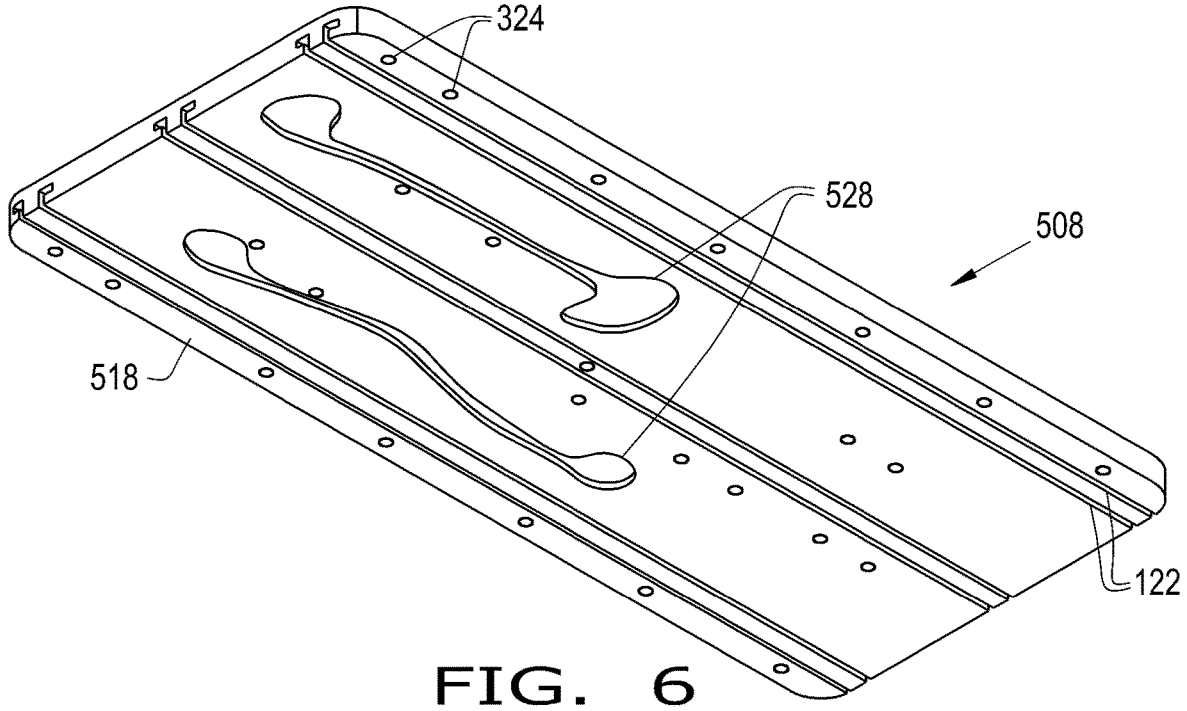
FIG. 6 is a bottom, perspective view of the chassis of FIG. 5.

Referring now to FIG. 6, there is shown a bottom, perspective view of chassis 508 of FIG. 5. Chassis 508 is shown to include composite body 518 with three slots 122 corresponding to three pontoons 106. Each slot 122, as shown, can extend the longitudinal extent of composite body 518. Further, additional fasteners 324 are embedded on the bottom portion of composite body 518. The bottom portion of composite body 518 also includes, like the top portion, recesses 528, which can be located in different positions relative to recesses 528 in the top portion of composite body 518. Recesses 528 on the bottom portion are configured for receiving and, as is necessary, routing therein device 530, as described above.

In sum, the present invention has been made in view of the complexity, material cost (typically) aluminum, and man-hours required to measure, cut, drill, and mount all of the required hardware to attach pontoons 106 (the floatation tubes) on the bottom of chassis 508, including splash pans, motor mounts, conduit and piping and other structures under the flooring, as well as the furniture, railings, trim pieces, motor mounts, helm and all other fixtures mounted on top of the floor (summarized as watercraft body 102 and/or device 530, depending upon whether fasteners 324 or recesses 528 are used).

In use, during manufacture, chassis 108, 308, 508 can be formed including a formed, molded, or cast (or other suitable way of manufacturing) structure, namely, composite body 118, 318, 518. Composite body 118, 318, 518 can be molded, for example, to include slots 122 and recesses 528 therein, and to embed fasteners 324. Any suitable manufacturing process can be used, such as any suitable forming process, molding process, or casting process, for example. Risers 120 can be slid into slots 122, either before or after attaching risers 120 to pontoons 106. Further, any additional structures associated with watercraft body 102 and/or device 530 can be connected to fasteners 324 and stored or routed in recesses 528, respectively. Devices 530 stored or routed in recesses 528 can be attached to composite body 518 in any suitable manner. Upon assembling watercraft 100, watercraft 100 can be floated or otherwise used on a body of water.

Figure 7:
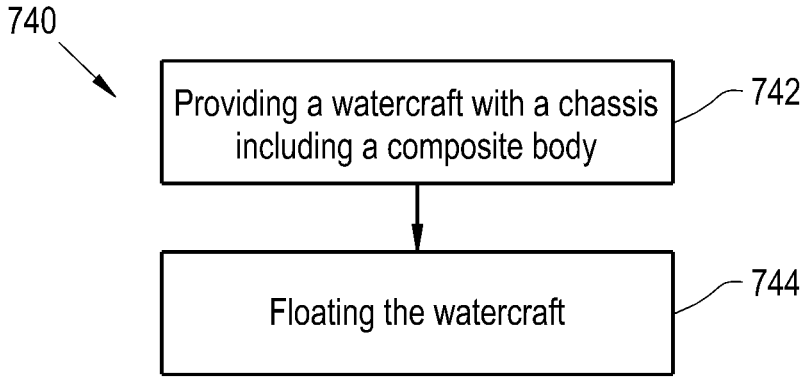
FIG. 7 is a flow diagram showing a method of using a watercraft, in accordance with an exemplary embodiment of the present invention.

Referring now to FIG. 7, there is shown a flow diagram showing a method 740 of using watercraft 100. Method 740 includes the steps of: providing 742 that the watercraft 100 includes: a watercraft body 102; and a pontoon frame system 104 coupled with the watercraft body 102, the pontoon frame system 104 including: a plurality of pontoons 106 spaced apart from one another and including a forward end 110, a rearward end 112, a first outboard pontoon 114, and a second outboard pontoon 116; and a chassis 108, 308, 508 coupled with and at least partially supporting the watercraft body 102, the chassis 108, 308, 508 supported by and coupling together the plurality of pontoons 106, the chassis 108, 308, 508 including a composite body 118, 318, 518 coupled with the first outboard pontoon 114 and the second outboard pontoon 116 at the forward end 110 and the rearward end 112; and floating 744 the watercraft 100. The plurality of pontoons 106 can include a plurality of risers 120 attached thereto, the composite body 118, 318, 518 including a plurality of slots 122 which slidably receive the plurality of risers 120. The composite body 318, 518 can include a plurality of fasteners 324 embedded therein. The composite body 518 can include at least one recess 528 configured for receiving a device 530 therein. The composite body 118, 318, 518 can include fiberglass, carbon fiber, and/or a polymer. The composite body 318 can include a high-voltage battery pack 326 therein.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pontoon frame system of a watercraft including a watercraft body, the pontoon frame system being coupled with the watercraft body, the pontoon frame system comprising:

a plurality of pontoons spaced apart from one another and including a forward end, a rearward end, a first outboard pontoon, and a second outboard pontoon;

a chassis configured for being coupled with and for at least partially supporting the watercraft body, the chassis supported by and coupling together the plurality of pontoons, the chassis including a composite body coupled with the first outboard pontoon and the second outboard pontoon at the forward end and the rearward end; and a plurality of risers attached to the plurality of pontoons, the composite body including a plurality of slots which slidably receive the plurality of risers.

2. The pontoon frame system of claim 1, further including a plurality of fasteners embedded in the composite body.

3. The pontoon frame system of claim 2, wherein the composite body includes at least one recess configured for receiving a device therein.

4. The pontoon frame system of claim 1, wherein the composite body includes at least one of fiberglass, carbon fiber, and a polymer.

5. The pontoon frame system of claim 1, further including a high-voltage battery pack embedded in the composite body.

6. A watercraft, comprising:

a watercraft body; and a pontoon frame system coupled with the watercraft body, the pontoon frame system including:

a plurality of pontoons spaced apart from one another and including a forward end, a rearward end, a first outboard pontoon, and a second outboard pontoon;

a chassis coupled with and at least partially supporting the watercraft body, the chassis supported by and coupling together the plurality of pontoons, the chassis including a composite body coupled with the first outboard pontoon and the second outboard pontoon at the forward end and the rearward end; and a plurality of risers attached to the plurality of pontoons, the composite body including a plurality of slots which slidably receive the plurality of risers.

7. The watercraft of claim 6, wherein the pontoon frame system further includes a plurality of fasteners embedded in the composite body.

8. The watercraft of claim 7, wherein the composite body includes at least one recess configured for receiving a device therein.

9. The watercraft of claim 6, wherein the composite body includes at least one of fiberglass, carbon fiber, and a polymer.

10. The watercraft of claim 6, further including a high-voltage battery pack embedded in the composite body.

11. A method of using a watercraft, the method comprising the steps of:

providing that the watercraft includes:

a watercraft body; and a pontoon frame system coupled with the watercraft body, the pontoon frame system including:

a plurality of pontoons spaced apart from one another and including a forward end, a rearward end, a first outboard pontoon, and a second outboard pontoon;

a chassis coupled with and at least partially supporting the watercraft body, the chassis supported by and coupling together the plurality of pontoons, the chassis including a composite body coupled with the first outboard pontoon and the second outboard pontoon at the forward end and the rearward end; and a plurality of risers attached to the plurality of pontoons, the composite body including a plurality of slots which slidably receive the plurality of risers; and floating the watercraft.

12. The watercraft of claim 11, wherein the pontoon frame system further includes a plurality of fasteners embedded in the composite body.

13. The watercraft of claim 12, wherein the composite body includes at least one recess configured for receiving a device therein.

14. The watercraft of claim 11, wherein the composite body includes at least one of fiberglass, carbon fiber, and a polymer.

15. The watercraft of claim 11, wherein the pontoon frame system further includes a high-voltage battery pack embedded in the composite body.

* * * * *